US007554551B1

(12) United States Patent
Biyabani

(10) Patent No.: US 7,554,551 B1
(45) Date of Patent: Jun. 30, 2009

(54) DECOUPLING A COLOR BUFFER FROM MAIN MEMORY

(75) Inventor: Sara Ruhina Biyabani, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 453 days.

(21) Appl. No.: 09/589,621

(22) Filed: Jun. 7, 2000

(51) Int. Cl.
*G09G 5/399* (2006.01)

(52) U.S. Cl. ..... 345/539; 345/538; 345/544; 345/546; 345/549; 345/553

(58) Field of Classification Search ..... 345/531, 345/539, 549, 553, 542, 544, 538
See application file for complete search history.

(56) References Cited

U.S. PATENT DOCUMENTS

| | | | | |
|---|---|---|---|---|
| 5,241,642 | A * | 8/1993 | Norsworthy et al. | 345/544 |
| 5,519,825 | A * | 5/1996 | Naughton et al. | 345/473 |
| 5,900,885 | A * | 5/1999 | Stortz | 345/537 |
| 6,002,441 | A | 12/1999 | Bheda et al. | 345/521 |
| 6,075,543 | A * | 6/2000 | Akeley | 345/539 |
| 6,100,906 | A * | 8/2000 | Asaro et al. | 345/539 |
| 6,184,908 | B1 * | 2/2001 | Chan et al. | 345/522 |
| 6,222,564 | B1 * | 4/2001 | Sturges | 345/531 |
| 6,304,297 | B1 * | 10/2001 | Swan | 348/556 |

FOREIGN PATENT DOCUMENTS

| | | | |
|---|---|---|---|
| EP | 0 525 986 A2 * | 6/1992 | |
| EP | 0525986 A2 | 2/1993 | |
| WO | WO/9706523 * | 2/1997 | |

OTHER PUBLICATIONS

"What is UMA?", Webopedia, http://www.webopedia.com/TERM/U/UMA.html, Copyright 2005 Jupitermedia Corporation, Date Accessed Dec. 5, 2005.*

Segal Mark, et al. "The OpenGL® Graphic System: A Specification (Version 1.2.1," Chapter 4, Per-Fragment Operations and the Framebuffer, Apr. 1, 1999, pp. 141-163.

Jupitermedia Corporation. "Integrated Video: Breaking the last PC Taboo," 802.11 Planet Conference & Expo World Tour, downloaded from the Internet at: www.cpuplanet.com/features/article.php/1566521, © 2003 Jupitermedia Corporation (2 pages).

Kocsis, David. "Frame-buffer wars: new directions in PC graphics," *EDN Access for Design, by Design*, May 9, 1996 (10 pages).

Silicon Graphics, Inc. "$O^2$ Unified Memory Architecture," *Silicon Graphics, Inc.*, 1997 (pp. 1-6).

Williams, Ian. "An Explanation of the Advantages Afforded by QED RM5200 and MIPS R12000 CPUs in O2," SGI White Paper, 1999 (pp. 1-41).

* cited by examiner

*Primary Examiner*—Antonio A Caschera
(74) *Attorney, Agent, or Firm*—Blakely, Sokoloff, Taylor & Zafman LLP

(57) ABSTRACT

A display color buffer in a unified memory architecture is decoupled from main memory by partitioning the address space for the color buffer into a frame-preparation memory accessed by a graphics subsystem at a frame rate to prepare color data and a refresh memory that is accessed by a display device at a refresh rate to display the color data. The color data is periodically transferred between the frame-preparation memory and the refresh memory, or when a frame of color data is ready for display.

22 Claims, 5 Drawing Sheets

DECOUPLING A COLOR BUFFER FROM MAIN MEMORY

FIELD OF THE INVENTION

This invention relates generally to computer graphics, and more particularly to partitioning memory used for computer graphics.

COPYRIGHT NOTICE/PERMISSION

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever. The following notice applies to the software and data as described below and in the drawings hereto: Copyright© 1999, Apple Computer, Inc., All Rights Reserved.

BACKGROUND OF THE INVENTION

A separate video card containing a graphics chip and dedicated frame buffer memory are in common use in personal computers and workstations. Alternative architectures that integrate the functions of the graphics chip with the central processing unit (CPU), or with another standard computer component, are becoming more prevalent due to the economies of scale of manufacturing such integrated components and because the integrated design requires fewer components. Under a unified memory architecture, the graphics frame buffer memory is integrated into the main memory and contributes to the total memory bandwidth required to operate the computer.

Over the years the screen resolutions have increased substantially and can place a high demand on memory bandwidth in a unified memory architecture. For example, at a resolution of 1600×1200, 32-bit color depth at 75 MHz refresh frequency, nearly 0.55 GB/s of memory bandwidth is used to simply refresh the screen. (See Table 1).

TABLE 1

| | 16 bit Color Depth | | | 24 bit Color Depth | | | 32 bit Color Depth | | |
|---|---|---|---|---|---|---|---|---|---|
| Resolution | 60 Hz | 75 Hz | 85 Hz | 60 Hz | 75 Hz | 85 Hz | 60 Hz | 75 Hz | 85 Hz |
| 640x480 | 35 | 44 | 50 | 53 | 66 | 75 | 70 | 88 | 100 |
| 800x600 | 55 | 69 | 78 | 82 | 103 | 117 | 110 | 137 | 156 |
| 1024x768 | 90 | 113 | 128 | 135 | 169 | 191 | 180 | 225 | 255 |
| 1280x1024 | 150 | 188 | 213 | 225 | 281 | 319 | 300 | 375 | 425 |
| 1600x1200 | 220 | 275 | 311 | 330 | 412 | 467 | 439 | 549 | 623 |
| 1920x1080 | 237 | 297 | 336 | 356 | 445 | 504 | 475 | 593 | 672 |

Thus, reducing the main memory bandwidth consumed by graphics processing in a unified memory architecture computer would correspondingly reduce the peak bandwidth requirements for the main memory and permit the use of less expensive memory devices in the computer.

SUMMARY OF THE INVENTION

The above-mentioned shortcomings, disadvantages and problems are addressed by the present invention, which will be understood by reading and studying the following specification.

In a unified memory architecture computer system, memory used for a color buffer is decoupled from a main memory through operations of a memory controller. The color buffer is logically divided into address spaces for a frame-preparation memory and for a refresh memory. The address space for the frame-preparation memory is mapped to the main memory, while the address space for the refresh memory is mapped to a separate, dedicated memory. The memory controller logically connects the frame-preparation memory to a graphics subsystem, which writes data into the frame-preparation memory at a frame rate, and logically connects the refresh memory to a display device, which reads data from the refresh memory at a refresh rate. The memory controller copies data from the frame-preparation memory to the refresh memory at various intervals.

Partitioning the memory address space of the color buffer into the frame-preparation memory and the refresh memory separates the memory traffic for refreshing the display device from the traffic to the main memory, thus decoupling the color buffer from the main memory in that all of main memory is no longer required to be accessed or read at the refresh rate of the refresh memory. Instead, main memory is only accessed when building a new frame within the color buffer while the extra main memory bandwidth previously required to refresh the colors on a display device is now off-loaded to the separate refresh memory. This separation of memory address spaces results in less peak bandwidth requirements for main memory, allowing the use of less expensive memory devices, and hence a cheaper overall system solution.

In another aspect, the address space of the color buffer is divided into two logical buffers, with the address space of one of the buffers being mapped to the separate, dedicated memory. At any one time, one of the buffers is serving as the frame-preparation memory while the other is serving as the refresh memory. When a frame is completed in the buffer currently serving as the frame-preparation memory, the memory controller switches the functions of the buffers, making the buffer holding the completed frame the transfer memory so that the display device can be refreshed. The reduction in peak memory bandwidth requirements for main memory is proportionally reduced.

The present invention describes computer systems, methods, and computer-readable media of varying scope. In addition to the aspects and advantages of the present invention described in this summary, further aspects and advantages of the invention will become apparent by reference to the drawings and by reading the detailed description that follows.

DETAILED DESCRIPTION OF THE INVENTION

In the following detailed description of embodiments of the invention, reference is made to the accompanying drawings in which like references indicate similar elements, and in which is shown by way of illustration specific embodiments in which the invention may be practiced. These embodiments are described in sufficient detail to enable those skilled in the art to practice the invention, and it is to be understood that other embodiments may be utilized and that logical, mechanical, electrical and other changes may be made without departing from the scope of the present invention. The following detailed description is, therefore, not to be taken in a limiting sense, and the scope of the present invention is defined only by the appended claims.

Figure 1:
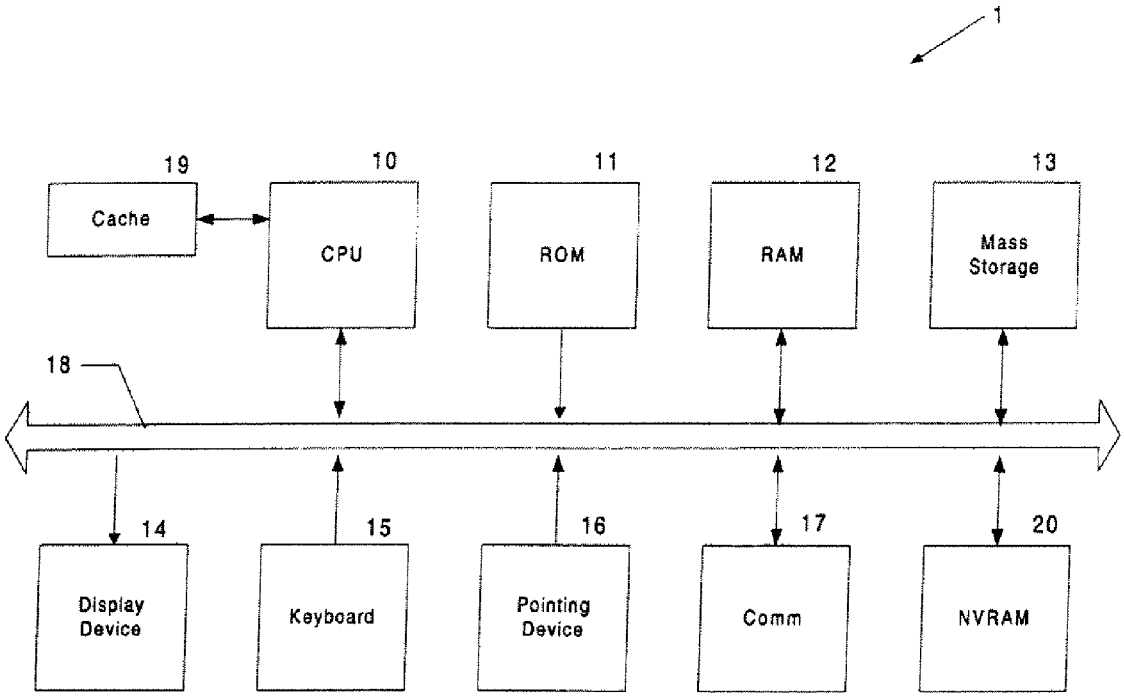
FIG. 1 is a diagram of one embodiment of a computer system environment suitable for practicing the invention.

The following description of FIG. 1 is intended to provide an overview of computer hardware and other operating components suitable for implementing the invention, but is not intended to limit the applicable environments. Various details provided in this description are specific to Macintosh computer systems. Note, however, that the concepts of the present invention are not limited to application to a Macintosh platform. For example, these concepts may also be applied to x86 processor based computer systems, as well as other types of computing platforms.

FIG. 1 illustrates a computer system 1 in which the present invention may be implemented. While FIG. 1 illustrates the major components of a computer system, it is not intended to represent any particular architecture or manner of interconnecting the components; such details are not germane to the present invention.

As shown, the computer system 1 of FIG. 1 includes a microprocessor 10, a read-only memory (ROM) 11, random access memory (RAM) 12, each connected to a bus system 18. The bus system 18 may include one or more buses connected to each other through various bridges, controllers and/or adapters, such as are well-known in the art. For example, the bus system may include a "system bus" that is connected through an adapter to one or more expansion buses, such as a Peripheral Component Interconnect (PCI) bus, or the like. Also connected to the bus system 18 are a mass storage device 13, a display device 14, a keyboard 15, a pointing device 16, a communication device 17, and non-volatile RAM (NVRAM) 20. A cache memory 19 is connected to the microprocessor 10.

Microprocessor 10 may be any device capable of executing software instructions and controlling operation of the computer system, such as a PowerPC processor, for example, or an x86 class microprocessor. ROM 11 may be a non-programmable ROM, or it may be a programmable ROM (PROM), such as electrically erasable PROM (EEPROM), Flash memory, etc.

Mass storage device 13 may include any device for storing suitably large volumes of data, such as a magnetic disk or tape, magneto-optical (MO) storage device, or any variety of Digital Versatile Disk (DVD) or compact disk ROM (CD-ROM) storage. The data is often written, by a direct memory access process, into RAM 12 during execution of software in the computer system 1. One of skill in the art will immediately recognize that the term "computer-readable medium" includes any type of storage device that is accessible by the microprocessor 10.

Display device 14 may be any device suitable for displaying alphanumeric, graphical and/or video data to a user, such as a cathode ray tube (CRT), a liquid crystal display (LCD), or the like, and associated controllers. Pointing device 16 may be any device suitable for enabling a user to position a cursor or pointer on display device 14, such as a mouse, trackball, touchpad, stylus with light pen, voice recognition hardware and/or software, etc.

Communication device 17 may be any device suitable for or enabling the computer system 1 to communicate data with a remote processing system over a communication link, such as a conventional telephone modem, a cable television modem, an Integrated Services Digital Network (ISDN) adapter, a Digital Subscriber Line (xDSL) adapter, a network interface card (NIC), an Ethernet adapter, a wireless transmitter/receiver, etc.

It will be appreciated that the computer system 1 is one example of many possible computer systems which have different architectures. The computer system of FIG. 1 may be, for example, an Apple Macintosh computer, such as an Apple iMac computer. FIG. 1 is also illustrative of personal computers based on an Intel microprocessor. Such personal computers often have multiple buses, one of which can be considered to be a peripheral bus. Network computers are another type of computer system that can be used with the present invention. Network computers do not usually include a hard disk or other mass storage, and the executable programs are loaded from a network connection into the RAM 12 for execution by the microprocessor 10. A Web TV system, which is known in the art, is also considered to be a computer system according to the present invention, but it may lack some of the features shown in FIG. 1, such as certain input or output devices. A typical computer system will usually include at least a processor, memory, and a bus connecting the memory to the processor.

Furthermore, one of skill in the art will immediately appreciate that the invention can be practiced with other computer system configurations, including hand-held devices, multiprocessor systems, microprocessor-based or programmable consumer electronics, network PCs, minicomputers, mainframe computers, and the like. The invention can also be practiced in distributed computing environments where tasks are performed by remote processing devices that are linked through a communications network.

It will be apparent from this description that aspects of the present invention may be embodied, at least in part, in software. That is, the technique may be carried out in a computer system in response to its microprocessor executing sequences of instructions contained in a memory, such as ROM 11, RAM 12, mass storage device 13, cache 19, or a remote storage device. In various embodiments, hardwired circuitry may be used in place of, or in combination with, software instructions to implement the present invention. Thus, the technique is not limited to any specific combination of hardware circuitry and software, nor to any particular source for the instructions executed by a computer system.

In addition, throughout this description, various functions and operations are described as being performed by or caused by software code (or other similar phrasing) to simplify description. However, those skilled in the art will recognize that what is meant by such expressions is that the functions result from execution of the code by a processor, such as microprocessor 10.

It will also be appreciated that the computer system 1 is controlled by operating system (OS) software which includes a file management system, such as a disk operating system, which is part of the operating system software. The file management system is typically stored in the mass storage 13 and causes the microprocessor 10 to execute the various acts required by the operating system to input and output data and to store data in memory, including storing files on the mass storage 13.

The operation of one embodiment of the invention within a computer, such as computer 1 in FIG. 1, is described next with reference to FIG. 2. A unified memory architecture for a computer 200 contains a main memory 203, such as RAM 12 in FIG. 1, that is managed by a memory controller 201. The memory controller logically partitions the address space of main memory 203 into video memory for use by a graphics subsystem 209 and processor memory for use by a central processing unit (CPU) 221. The graphics subsystem 209 is integrated with the memory controller 201 and includes a video engine 211, a two-dimensional engine 213 and a three-dimensional engine 215 but the invention is not so limited. Processor bus 223 and input/output bus 225 connect together the CPU 221, graphics subsystem 209, memory controller 201, and various peripheral devices (not shown).

As is conventional, the address space of the video memory is logically divided into several types of buffers, including a frame buffer which is further subdivided into buffers that handle various attributes of a frame, such as color buffer 204. In the present invention, the memory controller 201 logically partitions the address space of the color buffer 204 into a frame-preparation memory 205 and a refresh memory 207. The address space of the frame-preparation memory 205 is mapped to the main memory 203, while the address space of the refresh memory 207 is mapped to a separate, dedicated memory.

The frame-preparation memory 205 is logically connected to the graphics subsystem 209 to hold one or more frames of color data as the frames are being prepared for display by the various engines 211, 213, 215. Data is written into the frame-preparation memory 205 by the graphics subsystem 209 at a frame rate, which is a function of the application load and the capacity of the graphics subsystem 209 and various graphics software drivers.

When a frame of color data is completed and ready for display, the memory controller 201 transfers the frame to the refresh memory 207, where it is converted from digital to analog format by DAC 217 and displayed on display device 219. The front or visible color data is read out of the refresh memory 207 by the DAC 217 at a rate that will support the refresh rate of the display device 219, which is a function of the color depth (or color resolution) of the color buffer and the screen resolution and the refresh frequency of the display device 219.

Partitioning the memory address space of the color buffer into the frame-preparation memory 205 and the refresh memory 207 decouples the color buffer from main memory by directing the memory traffic necessary to refresh the display device 219 to the separate, dedicated memory instead of to the main memory. The only color data directed to the main memory 203 is for the purpose of forming of a new frame in frame-preparation memory 205 and the extra bandwidth previously required to refresh the display device 219 is now off-loaded to the separate refresh memory 207. This can be an important change since the bandwidth for refresh rate is actually less than the bandwidth for frame formation. Thus, the overall bandwidth requirement of the main memory 203 for graphics operations is reduced by the amount of bandwidth required to sustain the refresh rate of the display device 219.

It should be noted that the partitioning scheme of the present invention is distinct from the well-known technique of "double-buffering," in which two color buffers reside in the main memory. The present invention neither requires nor excludes double-buffering. In cases where double-buffering of the color buffer is desired, in one embodiment, the present invention specifies that the currently-designated active ("front") color buffer be copied over to the refresh memory. When the color buffer is not double-buffered, the sole color buffer is copied over to the refresh memory at the completion of the frame formation.

Figure 2:
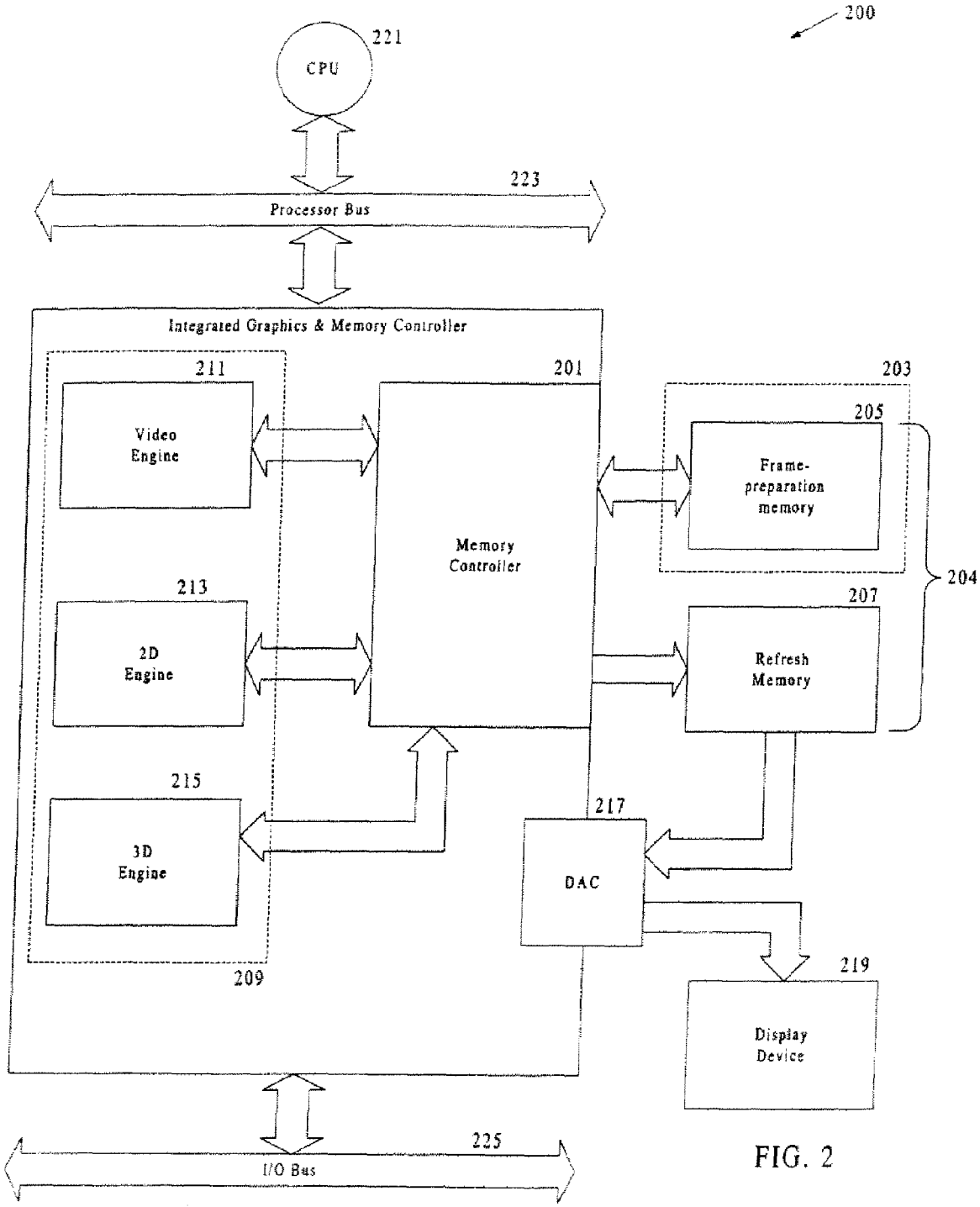
FIG. 2 is a diagram illustrating the operation of an embodiment of the invention within a unified memory architecture for a computer system for displaying graphics.
Figure 3:
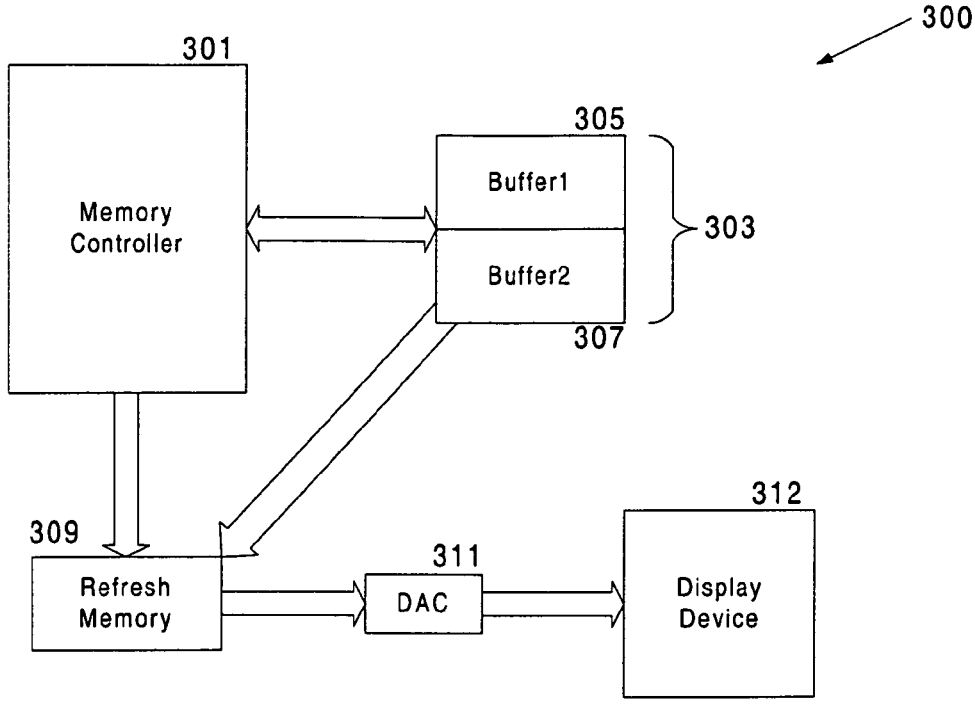
FIG. 3 is a diagram illustrating the operations of the unified memory architecture according to an alternate embodiment of the invention.

FIG. 3 illustrates an alternate embodiment of the invention in which a memory controller 301 partitions the address space of a color buffer 303 into three parts, the refresh memory 309 and two logical buffers 305, 307. As before, the address space of the refresh memory 309 is mapped to a separate, dedicated memory, while the address spaces for the two logical buffers 305, 307 are mapped to main memory. The DAC 311 is directly connected to the refresh memory 309 as was previously described in conjunction with FIG. 2.

At any given point in time, one of the two logical buffers, e.g. buffer1 305, is acting as the frame-preparation memory. The other buffer, e.g. buffer2 307, is being used as a transfer memory and holds a completed frame of color data. The frame in the transfer memory is copied to the refresh memory 309 for display on the display device 312. When the color data in the buffer1 305 is ready for display, the memory controller 301 switches to using the other buffer, e.g. buffer2 307, as the frame-preparation memory so that buffer1 305 now functions as the transfer memory. While the next frame is being readied in the buffer2 307, the completed frame in buffer1 305 (serving as the transfer memory) is copied to the refresh memory 309. When the frame in buffer2 307 is completed, the memory controller 301 switches the functions of the buffers 307, 309 again. In this embodiment, the memory controller 301 can immediately begin building a new frame of color data without having to wait for the frame to be copied from the frame-preparation memory into the refresh memory as in the embodiment illustrated in FIG. 2.

Figure 4:
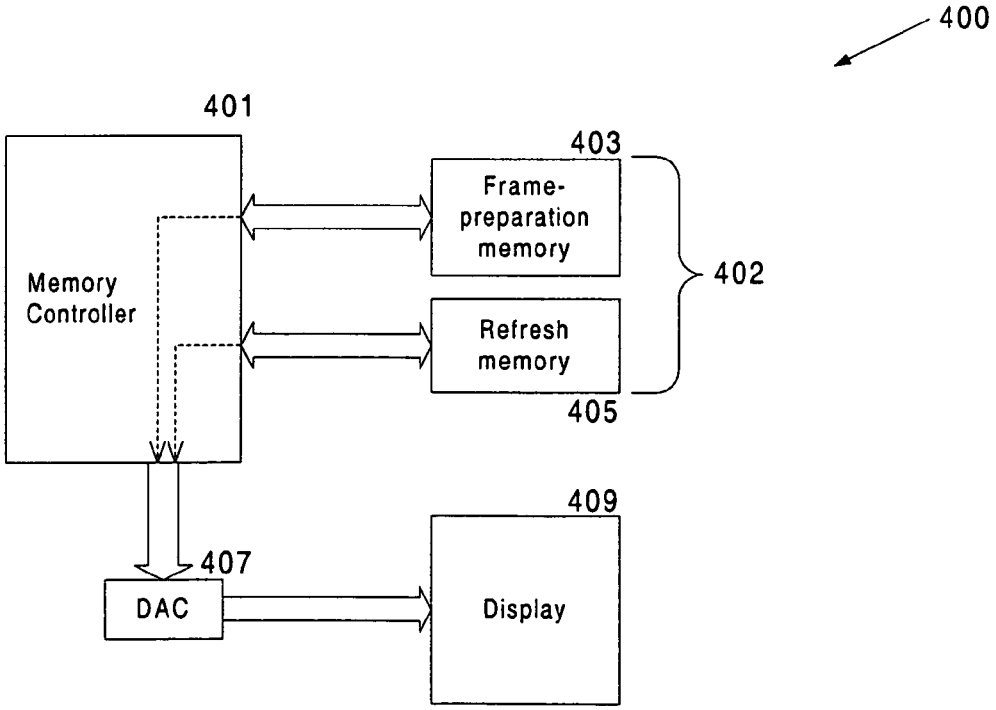
FIG. 4 is a diagram illustrating the operation of the unified memory architecture according to yet another alternate embodiment of the invention.

FIG. 4 illustrates another alternate embodiment in which a memory controller 401 partitions the address space of a color buffer 402 into two logical buffers 403, 405 and maps only one, e.g. refresh memory 405, to a dedicated, separate memory. The memory controller 401 alternates the functions of the frame-preparation memory and the refresh memory between the two logical buffers 403, 405. Because the dedicated, separate memory alternates between acting as the refresh memory and as the frame-preparation memory, there cannot be a permanent, direct connection between the DAC 407 and the dedicated, separate memory as in the previous embodiments. Instead the DAC 407 is directly connected to whichever of the two buffers is currently serving as the refresh memory (shown as dashed lines in FIG. 4).

Assume for purposes of illustration that buffer1 403 is currently serving as the frame-preparation memory, while buffer2 405 is serving as the refresh memory. When a frame is ready for display in the buffer 1 403, the memory controller 401 directly connects buffer1 403 to the DAC 407. The memory controller 401 begins using buffer2 405, i.e., the buffer that was previously serving as the refresh memory, as the frame-preparation memory. When the next frame of color data is complete in buffer2 405, the memory controller 401 directly connects the buffer2 405 to the DAC 407 to serve as the transfer memory and switches back to using buffer1 403 as the frame-preparation memory. As with the embodiment illustrated in FIG. 3, the memory controller 401 does not have to wait for the completed frame of color data to be copied from the frame-preparation memory into the refresh memory before building a new frame.

Although the embodiments of the invention described above are suitable for use with two-dimensional graphics subsystems in any computer system, they are especially applicable for use with three-dimensional graphics subsystems in computer systems in which main memory bandwidth is limited, such as a computer that utilizes a unified memory architecture. Additionally, the embodiments are easily implemented according to a three-dimensional graphics standard, such as OpenGL published by The OpenGL Architecture Review Board and available as version 1.2.1 at time of filing from the "opengl.org" web site. In particular, the frame-preparation memory and refresh memory correspond to the back and front color buffers, respectively, as defined in the OpenGL standard.

The particular methods to be performed by a memory controller programmed to support the embodiments of the invention are next described in terms of computer firmware with reference to a series of flowcharts. The methods to be performed by the memory controller can constitute executable instructions that are added to existing firmware for the controller or the methods can be implemented as hardware structures. Describing the methods by reference to a flowchart enables one skilled in the art to develop such instructions or structures that carry out the methods on suitable memory controllers. As no one type of memory controller is required, it will be appreciated that a variety of firmware instruction sets or hardware structures may be used to implement the teachings of the invention as described herein. Furthermore, it is common in the art to speak of firmware instructions, in one form or another, as taking an action or causing a result. Such expressions are merely a shorthand way of saying that execution of the firmware by a memory controller causes the controller to perform an action or produce a result. The existing firmware or hardware structures in the memory controller is assumed to provide an interface between the graphics subsystem and the portions of the main memory used by the graphics subsystem as is conventional and such operations are not illustrated.

Figure 5:
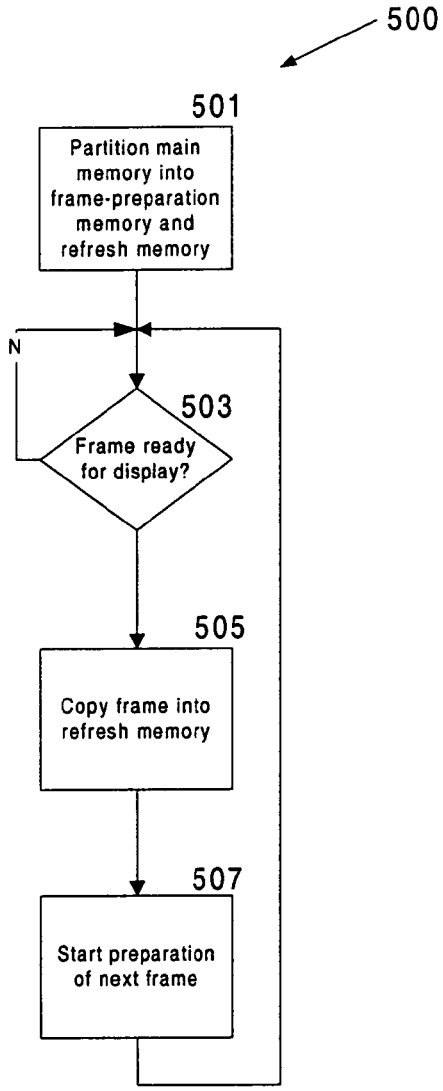
FIG. 5 is a flowchart of a method to be performed by a memory controller to implement the embodiments of the invention shown in FIG. 2.

Referring first to FIG. 5, a method 500 causes a memory controller to perform the operations for the embodiment of the invention illustrated in FIG. 2. The method 500 partitions the main memory address space for the color buffer into the frame-preparation memory and the refresh memory and this information is communicated to the portion of the controller that actually prepares the frame of color data (block 501). The process represented at block 501 also maps the refresh memory address space to the dedicated, separate memory that is directly connected to the DAC. The method 500 monitors the writing of the color data into the frame-preparation memory to determine when a frame of color is ready for display (block 503). The completed frame is then copied into the refresh memory (block 505) for transfer to the DAC. When the copying is complete, the frame-preparation memory can be used to prepare the next frame of color data (block 507). In a further embodiment, the method 500 copies portions of the color data for the frame from the frame-preparation memory into the refresh memory at pre-determined intervals before the entire frame is ready. Although not illustrated, the modifications to the method 500 necessary to implement such an embodiment will be readily apparent to one skilled in the art.

Figure 6:
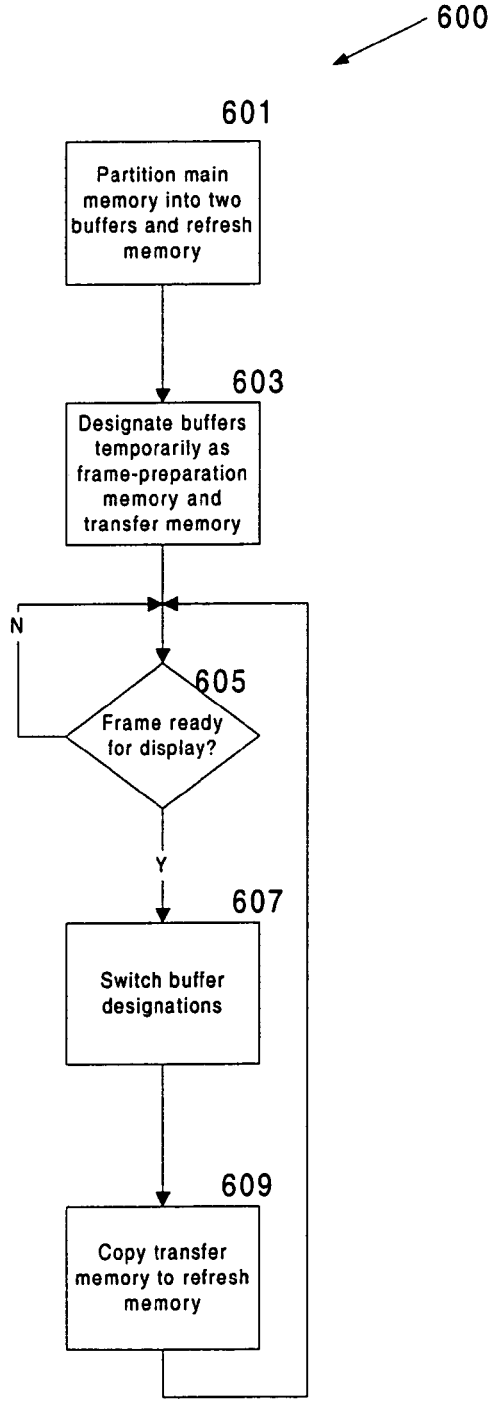
FIG. 6 is a flow chart of a method to be performed by a memory controller to implement the embodiments of the invention shown in FIG. 3.

Turning now to FIG. 6, a method 600 causes a memory controller to perform the operations required by the embodiment shown in FIG. 3. The method 600 partitions the main memory address space for the color buffer into the two logical buffers and the refresh memory (block 601). As before, part of the process represented at block 601 maps the refresh memory address space to the dedicated, separate memory that is directly connected to the DAC. One of the buffers is temporarily designated as the frame-preparation memory, the other as the transfer memory, and the buffer designated as frame-preparation memory is directly connected to a graphics subsystem (block 603). When a frame of color data is ready for display (block 605), the method 600 breaks the direct connection between the graphics subsystem and the buffer currently serving as the frame-preparation memory and establishes a direct connection between the graphics subsystem and the buffer currently serving as the transfer memory, thus switching the logical buffer designations (block 607). The buffer holding the just-completed frame of color data now functions as the transfer memory to copy the color data to the refresh memory (block 609). It will be appreciated that the monitoring of the frame-preparation memory is accomplished while the copy operation represented by block 609 is performed although not shown in FIG. 6 for ease in illustration.

Figure 7:
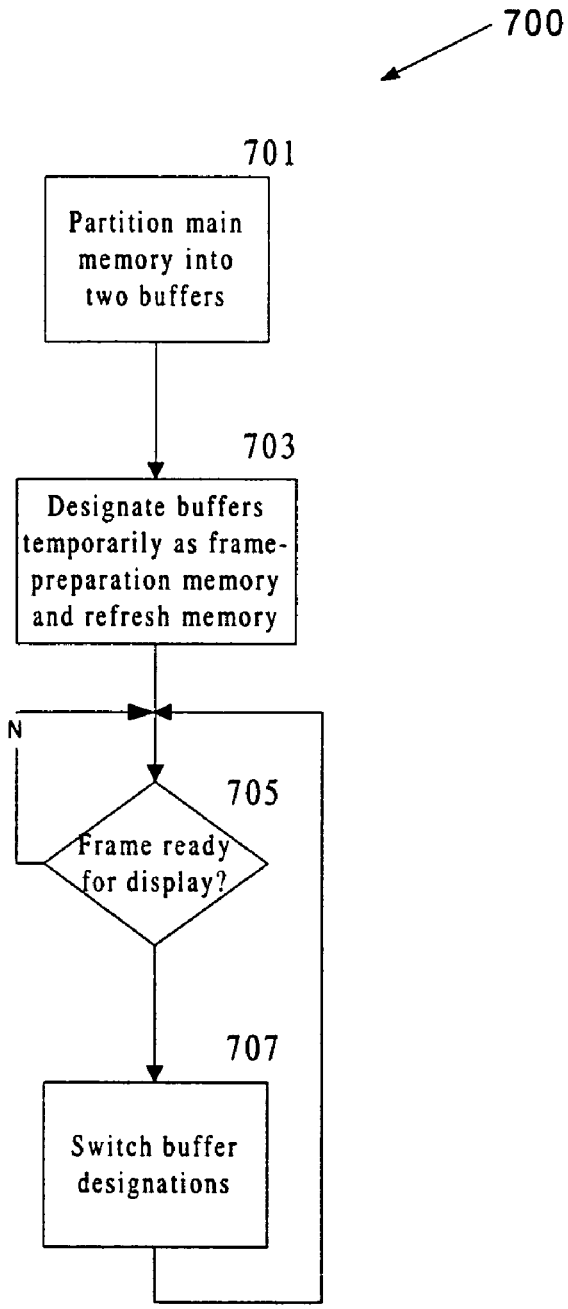
FIG. 7 is a flowchart of a method to be performed by a memory controller to implement the embodiments of the invention shown in FIG. 4.

FIG. 7 illustrates a method 700 that causes a memory controller to perform the operations for the embodiment of the invention shown in FIG. 4. The method 700 partitions the main memory address space for the color buffers into two buffers and maps one of the buffers to the separate, dedicated memory (block 701). As described above, the DAC is not permanently connected to the separate, dedicated memory in this embodiment. One of the buffers is temporarily designated as the frame-preparation memory, the other as the refresh memory, and directly connected to the graphics subsystem and the DAC, respectively (block 703). When the color data in the frame-preparation memory is ready for display (block 705), the method 700 directly connects the DAC to the buffer holding the completed frame while directly connecting the graphics subsystem to the other buffer (block 707). The buffer now connected to the DAC becomes the refresh memory and the buffer now connected to the graphics subsystem becomes the frame-preparation memory, thus switching the buffer designations.

The decoupling of a color buffer from main memory in a unified memory architecture has been described. Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the present invention.

For example, those of ordinary skill within the art will appreciate that one or more physical memory devices that make up main memory can serve as the separate, dedicated memory and only those memory devices must be capable of handling the extra refresh bandwidth. Furthermore, those of ordinary skill within the art will appreciate that the memory devices used as the main memory can be standard memory devices possessing no special characteristics other than those imposed by the overall architecture of the computer.

The terminology used in this application with respect to unified memory architectures is meant to include all environments in which main memory is shared, in some fashion, between the CPU and graphics processor. Therefore, it is manifestly intended that this invention be limited only by the following claims and equivalents thereof.

What is claimed is:

1. A memory architecture that decouples a color buffer from a main memory in a computer, the architecture comprising:

a sole memory controller connected to the main memory to manage use of the main memory between a graphics subsystem and a processing unit, the memory controller operable for partitioning an address space for the color buffer into two logical buffers, operable for designating one logical buffer as a frame-preparation memory and one logical buffer as a refresh memory, operable for connecting the frame-preparation memory to the graphics subsystem and operable for connecting the refresh memory to a display device, wherein a full frame of color data is written into the frame-preparation memory at a frame rate, read from the refresh memory at a rate that supports a refresh rate of the display device, the frame-preparation memory having a bandwidth that supports the refresh rate, the frame-preparation memory is mapped into a physical device for the main memory and the address space for the refresh memory is mapped into a physical memory device for a dedicated memory that is separate from the physical memory device for the main memory.

2. The memory architecture of claim 1, wherein the memory controller is further operable for copying the color data from the frame-preparation memory to the refresh memory.

3. The memory architecture of claim 2, wherein the memory controller copies the color data at pre-determined intervals.

4. The memory architecture of claim 2, wherein the memory controller copies the color data when an entire frame of color data is ready for display.

5. The memory architecture of claim 1, wherein the memory controller is further operable for further partitioning the address space for the color buffer into a third logical buffer, for designating the third logical buffer as a transfer memory, and for copying the color data from the transfer memory to the refresh memory.

6. The memory architecture of claim 5, wherein the memory controller is further operable for disconnecting the logical buffer currently designated as the frame-preparation memory from the graphics subsystem, and connecting the logical buffer currently designated as the transfer memory to the graphics subsystem to switch the designations of the logical buffers.

7. The memory architecture of claim 6, wherein the memory controller switches the designations of the logical buffers when an entire frame of color data is ready for display in the logical buffer currently designated as the frame-preparation memory.

8. The memory architecture of claim 1, wherein the memory controller is operable for connecting the logical buffer currently designated as the frame-preparation memory to the display device and the logical buffer currently designated as the refresh memory to the graphics subsystem to switch the designations of the logical buffers.

9. A method of decoupling a color buffer from a main memory by a sole memory controller in a computer, the memory controller managing use of the main memory between a graphics subsystem and a processing unit, the method comprising:

partitioning an address space for the color buffer into first and second logical buffers;

designating the first logical buffer as a refresh memory and designating the second logical buffer as a frame-preparation memory;

writing a full frame of color data into the frame-preparation memory at a frame rate;

copying the color data from the frame-preparation memory to the refresh memory;

reading the color data from the refresh memory at a rate that supports a refresh rate of a display device, wherein the frame-preparation memory has a bandwidth that supports the refresh rate, and;

mapping the address space for the frame-preparation memory onto a physical device for the main memory and the address space for the refresh memory onto a physical memory device for a dedicated memory separate from the physical memory device for the main memory.

10. The method of claim 9, wherein the color data is copied from the frame-preparation memory to the refresh memory when an entire frame of color data is ready for display.

11. The method of claim 9, wherein the color data is copied from the frame-preparation memory to the refresh memory at pre-determined intervals.

12. The method of claim 9, further comprising further partitioning the address space of the color buffer into a third buffer;

designating the third buffer as a transfer memory;

building a first frame of color data in the frame-preparation memory;

switching the designation of the second buffer with the designation of the third buffer when the first frame of color data is ready for display;

building a second frame of color data in the frame-preparation memory; and switching the designation of the third buffer with the designation of the second buffer when the second frame of color data is ready for display, wherein copying the color data from the frame-preparation memory to the refresh memory is accomplished by copying the color data from the buffer currently designated as the transfer memory.

13. A computer system comprising:

a processing unit;

a main memory connected to the processing unit though a system bus, the main memory being partitioned into an address space for a color buffer;

a sole memory controller connected to the main memory to manage use of the main memory between a graphics subsystem and the processing unit;

a graphics subsystem connected to the main memory through the memory controller to create a full frame of color data in the color buffer at a frame rate; and a display device connected to the main memory through the memory controller, to display a frame of color data from the color buffer at a refresh rate, wherein the frame-preparation memory has a bandwidth that supports the refresh rate and the memory controller decouples the color buffer from the main memory by:

partitioning the address space for the color buffer into two logical buffers;

designating one logical buffer as a frame-preparation memory and one logical buffer as a refresh memory, wherein the memory controller maps the address space for the frame-preparation memory to the main memory;

connecting the frame-preparation memory to the graphics subsystem;

connecting the refresh memory to the display device;

copying the color data from the frame-preparation memory to the refresh memory; and a memory device for a dedicated memory separate from a memory device for the main memory and the memory controller further maps the address space for the refresh memory to the memory device for the dedicated memory.

14. The computer system of claim 13, wherein the memory controller copies the color data at pre-determined intervals.

15. The computer system of claim 13, wherein the memory controller copies the color data when an entire frame of color data is ready for display.

16. The computer system of claim 13, wherein the memory controller further partitions the address space for the color buffer into a third logical buffer, designates the third logical buffer as a transfer memory and copies the color data from the transfer memory to the refresh memory in lieu of copying the color data from the frame-preparation memory.

17. The computer system of claim 16, wherein the memory controller further switches the designations of the logical buffers by connecting the logical buffer currently designated as the frame-preparation memory to the display system and by connecting the logical buffer currently designated as the transfer memory to the graphics subsystem.

18. The computer system of claim 17, wherein the memory controller switches the designations of the logical buffers when an entire frame of color data is ready for display in the logical buffer currently designated as the frame-preparation memory.

19. An apparatus for use in a memory architecture comprising:

means for preparing a full frame of color data for display, wherein said means for preparing includes memory; and a sole means for controlling use of a main memory between the means for preparing and a processing unit, for partitioning an address space in the main memory and a separate physical device that represents a color buffer into first and second logical buffers, for designating the first logical buffer as a refresh memory and the second logical buffer as a frame-preparation memory, for writing the color data into the frame-preparation memory at a frame rate, for copying the color data from the frame-preparation memory to the refresh memory, the frame-preparation memory having a bandwidth that supports the refresh rate, and for reading the color data from the refresh memory at a rate that supports a refresh rate of a display device, wherein the means for controlling further maps the address space for the frame-preparation memory onto a physical device for the main memory and the address space for the refresh memory onto the physical memory device for a dedicated memory separate from the physical memory device for the main memory.

20. The apparatus of claim 19, wherein the means for controlling copies the color data from the frame-preparation memory to the refresh memory when an entire frame of color data is ready for display.

21. The apparatus of claim 19, wherein the means for controlling copies the color data from the frame-preparation memory to the refresh memory at pre-determined intervals.

22. The apparatus of claim 19, wherein the means for controlling is further operable for partitioning the address space of the color buffer into a third buffer, designating the third buffer as a transfer memory, building a first frame of color data in the frame-preparation memory, switching the designation of the second buffer with the designation of the third buffer when the first frame of color data is ready for display, building a second frame of color data in the frame-preparation memory, and switching the designation of the third buffer with the designation of the second buffer when the second frame of color data is ready for display, and wherein the means for controlling copies the color data from the frame-preparation memory to the refresh memory by copying the color data from the buffer currently designated as the transfer memory.

* * * * *